United States Patent [19]

Tomasini

[11] 4,199,270

[45] Apr. 22, 1980

[54] DISPENSER-CONTAINER BRUSH FOR PASTE MATERIAL

[75] Inventor: Gianni Tomasini, Milan, Italy

[73] Assignee: Secunda AG fur Vermietung Von Wirtschaftsgutern, Bremgarten, Switzerland

[21] Appl. No.: 897,568

[22] Filed: Apr. 18, 1978

[30] Foreign Application Priority Data

Apr. 27, 1977 [IT] Italy ..... 22877 A/77

[51] Int. Cl.[2] ..... A46B 11/02

[52] U.S. Cl. ..... 401/183; 401/275; 401/276; 401/277; 401/279; 401/286

[58] Field of Search ..... 401/272–277, 401/281, 156, 162, 183–185, 270, 285

[56] References Cited

U.S. PATENT DOCUMENTS

| | | | |
|---|---|---|---|
| 922,947 | 5/1909 | Porter | 401/164 |
| 973,865 | 10/1910 | Hitz | 401/281 |
| 1,014,784 | 1/1912 | Tate | 401/281 |
| 1,114,646 | 10/1914 | Pap | 401/175 |
| 1,183,757 | 5/1916 | Obertop | 401/183 |
| 1,610,831 | 12/1926 | Wallace | 401/270 |
| 1,764,130 | 6/1930 | Vardeman | 401/271 |
| 2,226,663 | 12/1940 | Hill | 401/184 |
| 2,259,981 | 10/1941 | Aiken | 401/276 |
| 2,358,645 | 9/1944 | Kiff | 401/276 |
| 2,562,937 | 8/1951 | Moricich | 401/154 |
| 2,766,472 | 10/1956 | Durrett | 401/281 |
| 2,908,924 | 10/1959 | Turman | 401/270 |

FOREIGN PATENT DOCUMENTS

| | | | |
|---|---|---|---|
| 651523 | 10/1928 | France | 401/172 |
| 1339638 | 9/1963 | France | 401/176 |
| 416297 | 11/1946 | Italy | 401/277 |
| 1244915 | 9/1971 | United Kingdom | 401/270 |

*Primary Examiner*—Clyde I. Coughenour
*Attorney, Agent, or Firm*—Bacon & Thomas

[57] ABSTRACT

Dispenser-container brush for paste material, comprising:

(a) a stem or handle having a flexible wall, internally hollow reservoir portion, an intermediate zone provided with means for the engagement of a bristle holder head member; and a substantially rigid elongated portion, said elongated portion having a dispensing opening for the paste material;

(b) a substantially rigid bristle holder head member, having a bristle arrangement on an outer side or face and comprising an inner cavity of shape and size substantially corresponding to those of said elongated handle portion: a portion for engagement in said means on the intermediate handle portion, and a dispensing hole for the paste material in the face or side provided with said bristles, the position of said dispensing hole being such that the hole can be brought in register with said dispensing opening in the handle.

According to an embodiment, the dispensing hole can be brought in register with the dispensing opening by a rotary movement; according to another embodiment, the movement for bringing said hole to coincide with said opening is a translational movement.

8 Claims, 9 Drawing Figures

DISPENSER-CONTAINER BRUSH FOR PASTE MATERIAL

This application is concerned with brushes, particularly tooth-brushes, made to include a tooth paste reservoir, the tooth paste being dispensable on bristles as required.

Such brushes as hitherto used have not met a favourable commerical acceptance because of suffering from many disadvantages. As a matter of fact, known brushes of this type are either cumbersome and unhandy, or costly to manufacture, or paste dispensing does not occur in a metered and reliable manner, so that the hands get dirty with paste, or again do not present sufficient hygienics allowances.

It is the object of the present application to provide a brush, or tooth-brush, for overcoming the aforesaid disadvantages. Such a brush comprises a flexible container-like handle or stem, adjacent one end having an opening for dispensing the paste material therein contained; and an internally hollow bristle holder head member for fitting to an end of said handle or stem, and at the bristle base provided with a paste material dispensing hole.

This container handle or stem may be of refillable type with new paste material, or not refillable or disposable type.

Particularly, it is the object of the present application to provide a brush assembly, of a type comprising a paste material containing and dispensing handle, characterized by comprising:

(a) a stem or handle having a flexible wall, internally hollow reservoir portion; an intermediate zone with means for engaging a bristle holder head member; and a substantially rigid elongated portion, said elongated portion having a paste material dispensing opening;

(b) a substantially rigid bristle holder head member, having a bristle arrangement on an outer face and including an inner cavity of shape and size substantially corresponding to those of said elongated portion of the handle; a portion of engagement in said means on the intermediate portion of the handle, and a paste material dispensing hole in the bristle-fitted face, the position of said dispensing hole being such that the hole can be made to correspond with said dispensing opening in the handle.

According to an embodiment, this dispensing hole can be made to correspond with the dispensing opening through a rotary movement, and according to a further embodiment, the movement for causing said hole to coincide with said opening is a translatory movement.

According to another feature of the present application, a tube housing is provided for the brush, and is of a size suitable for pressure holding thereon.

A brush according to this application is functional, easy to use, completely hygienical and relatively inexpensive.

It should be noted that, although the description is related to a tooth-brush and tooth paste, it will be appreciated that by slight modifications a brush according to the present invention could be used for other purposes such as, for example, shoe shining, and the paste material could be another material such as, for example, a semi-liquid shoe polish.

Some preferred embodiment of the subject of the present application will now be described with reference to the accompanying drawings, in which.

Figure 1:
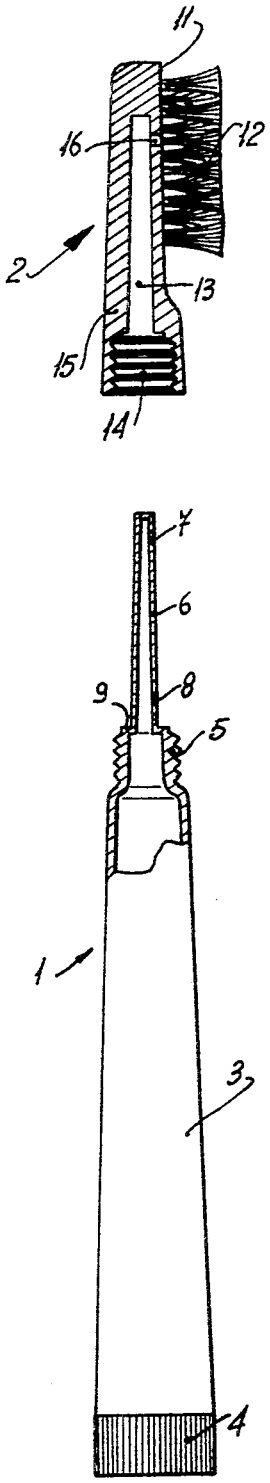
FIG. 1 is an exploded, partly sectional view of an embodiment for a brush according to the present application.

As shown in FIG. 1, a brush comprises a stem or handle designated at 1 and a bristle holder head member designated at 2. This stem includes a handgrip portion 3, which is of frusto-conical configuration in the figure and is internally hollow for providing the tooth paste reservoir. Said reservoir forming portion 3 is comparatively flexible for the paste material to be squeezed out, but should be sufficiently rigid to avoid excess bending in use. Said wall may be made of plastics material and possibly longitudinally ribbed. At one end, or that end corresponding to the major base of the truncated cone in the figure, said reservoir portion 3 has an opening (not shown) for the introduction of the paste material, this opening being closed by a cover system 4 to be described in the following.

Thus, at the opposite side of the reservoir to the plug, the stem has an externally threaded zone 5, and there beyond an elongated internally hollow portion 6, which communicates with the reservoir. Preferably, said portion 6 is frusto-conical and tapers to the farthermost end from the reservoir. Adjacent to such an end and on the conical skirt an opening 7 is provided, communicating the internal hollow with the outside. Preferably, a further or vent opening 8 is provided at a location spaced apart from said opening 7 toward thread 5. Along the circumference joining threaded zone 5 and elongated portion 6 a shoulder 9 is preferably provided. The entire stem 1 may be integrally formed, for example of plastic material, or said elongated portion 6 may be made of a more rigid material and joined or connected to portions 3 and 5.

Bristle holder head member 2 may be of any external shape and on at least one face or side 11 carries a bristle arrangement 12. Internally, said head member 2 has a cavity 13 exactly corresponding as to shape and size to the shape and size of said elongated stem portion 6. At its connection location to the stem, head member 2 has an internal thread 14 for meshing with thread 5 on the stem, and between thread zone 14 and cavity 13 a shoulder 15 is provided. On the bristle carrying side or face 11, a through hole 16 (also shown in FIG. 3) is provided and communicates said cavity 13 with the outside at the base of the bristles 12.

Figure 4:
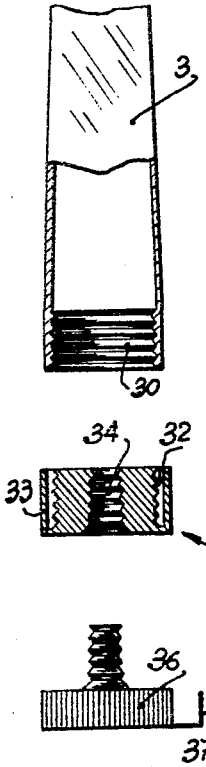
FIG. 4 is an exploded, partly sectional view of the handle or stem loading end.

The cover system 4 for the container handle may be of any known type. However, the preferred system (FIG. 4) comprises a thread 30 on the handle end, generally an inner thread, a cap 31 formed with a thread 32 mating with thread 30, and provided with an outer skirt 33, suitable to arrange about the end of handle 3, and a threaded hole 34 for accomodating the neck of a tooth paste tube for recharging, a plug 36 for closing said threaded hole 34 and preferably carring means 37 for suspending the brush.

Skirt 33 performs the function of stiffening the wall of handle 3, when said cap 31 is screwed on or unscrewed from thread 30.

Figure 5:
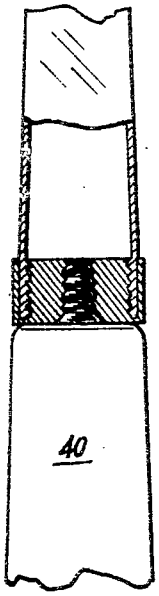
FIG. 5 is a cut away view of a tooth paste tube inserted in a handle for reloading.

The brush is filled with paste material by inserting (FIG. 5) the mouth or inlet of a tooth tube 40 in said threaded hole 34 of cap 31 applied to handle 3. During this operation, the bristle holder head member is preferably moved away from the stem to allow for air to vent through vent opening 8. Then, tube 40 is removed, and the loading hole is closed by plug 36, and the bristle holder head portion is screwed down with thread 14 on thread 5. Thus, the elongated handle portion 6 is fully accomodated within cavity 13, and vent hole 8 is closed by the wall thereof. The interengagement between said shoulders 15 and 9 prevents casual exiting of paste material which may have escaped into chamber or cavity 13.

The stem dispensing opening 7 may be arranged or not at the dispensing hole 16 of the bristle holder head member 2 and by rotation of the latter the passage from corresponding or opening position to not corresponding or closing position is obtained. Preferably, there will be suitable reference marks on head member 2 and stem 1 for easily indicating said opening and/or closing position. When opening 7 and hole 16 are at open position a simple pressure applied to stem portion 3 dispenses paste material at the bristle zone 12. When said opening 7 and hole 16 are offset, or at closed position, the paste material is inhibited from exiting by casually applying a pressure on stem reservoir 3 and no contaminating materials that may be present on the brush can enter the reservoir.

When desiring to completely remove the residual tooth paste in the container handle, for example in order to change the type of tooth paste, it is an easy matter to unscrew cap 31 from handle 3, thereby availing a larger passage for washing and throughly cleaning the brush interior.

Thus, it will be appreciated that a brush has been provided which is highly reliable, hygienical, easy to use and clean, and yet relatively simple.

Figure 2:
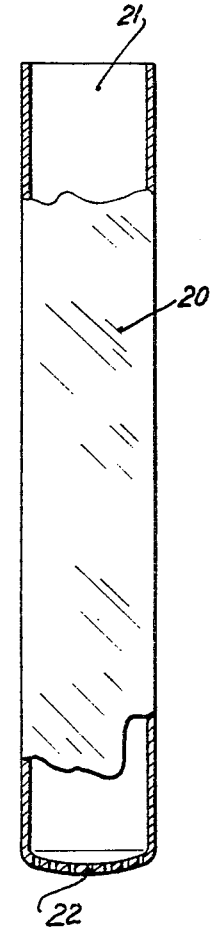
FIG. 2 is a fragmentary sectional view of a tube housing for the brush.
Figure 3:
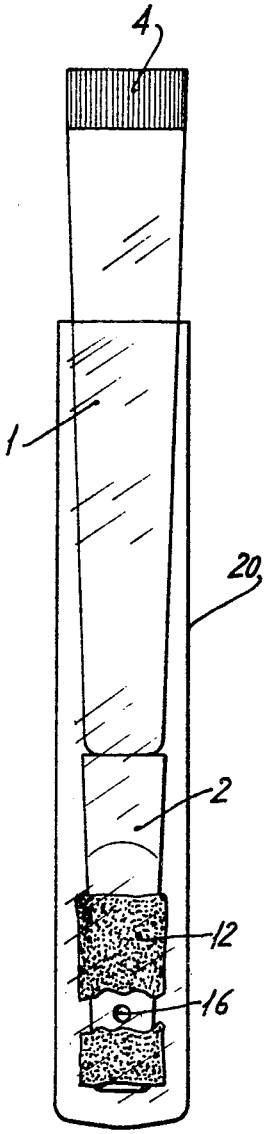
FIG. 3 is a view similar to that of FIG. 2 with the brush inserted in the housing and part of the bristles therein removed to show the paste dispensing hole.

For use, it is preferred that the brush is kept with its bristle holder head member at the bottom or downward directed, so that the paste material is always adjacent the dispensing opening (in order to avoid time wasting operations of squeezing and material loss along the reservoir walls, should the material be accumulated adjacent cover 4). To maintain such an attitude, a housing 20 (FIG. 2) has been designed, which comprises a tubular element having an open end 21 and a closed end 22, which may be provided with small holes for the drainage of possible liquids. The inner dimensions of this housing 20 are such that the brush can be accomodated therein with the head member to end 22 and engage by a slight pressure a portion of its stem (FIG. 3). Where the paste material to be dispensed is, for example, shoe-polish, it may be advantageous also to provide said housing with an externally flat, unperforated closed bottom, serving as a bearing means.

Figure 7:
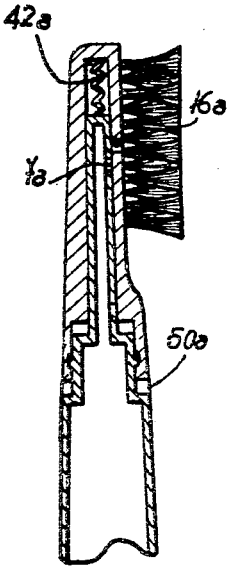
FIG. 7 is a fragmentary view of the brush shown in FIG. 6 in assembled condition.
Figure 6:
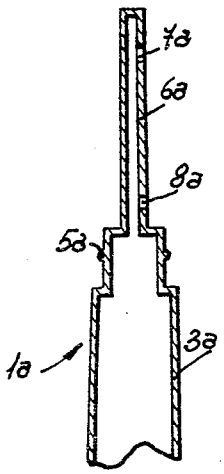
FIG. 6 is an exploded view of a second type of brush.

A modified embodiment of the brush is shown in FIGS. 6 and 7. Those elements which are similar to those of the main embodiment have been denoted by the same reference numerals followed by letter a, and those elements that are identical will not be described in detail.

The brush of this embodiment comprises a container handle 1*a*, the elongated portion 6*a* of which is substantially cylindrical. The chamber or cavity 13*a* of bristle holder head member 2*a* is also cylindrical. The engagement between said handle 1*a* and head member 2*a* is effected by lugs or projections, such as 5*a*, provided on the surface of one of the two elements, either the head member or handle, engaging in grooves, such as 14*a*, provided on the opposite face of the other of said two elements. Grooves 14*a* are of shape that a slight mutual sliding is allowed between the two elements.

Between the end surface of elongated portion 6*a* and the bottom of chamber or cavity 13*a* a spring 42*a* is interposed. This spring hold head member 2*a* and handle 1*a* at such a mutual position that said dispensing opening 7*a* will not concide with dispensing hole 16*a* (or at a position of no exit for the tooth paste). For tooth paste exit, the handle has to be axially moved relative to the head member, by compressing said spring 42*a* for the time required for causing the desired amount to exit by squeezing the handle reservoir portion 3*a*. In order to cover the circular gap which would exist between said bristle holder head member and stem (FIG. 7) at rest or inoperative position, the bristle holder head member is extended by a circular skirt 50*a*.

Figure 8:
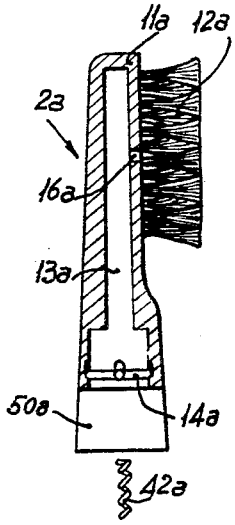
FIGS. 8 and 9 show a closing or sealing system for the container handle in a disposable non-rechargeable type of brush.
Figure 8:
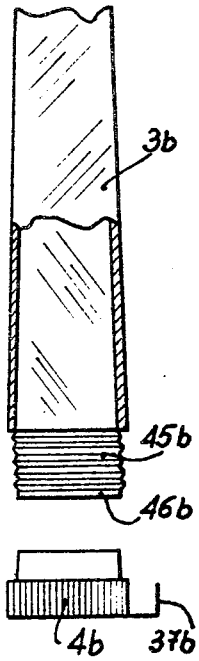
Figure 9:
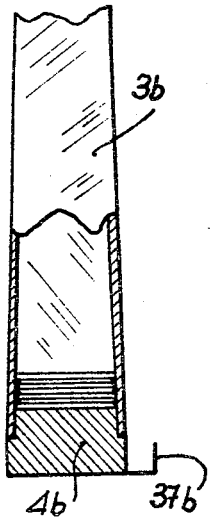

A further modified embodiment of a brush according to the present application is shown in FIGS. 8 and 9. In this case, the brush is a disposable type of brush, that is a brush that is sold already loaded with paste material and, upon consumption of the charge, has to be thrown away. It is believed that this type of brush is useful in certain cases (for example, for hotels, hospitals, or for sale as charged with a given brand of tooth paste).

In FIGS. 8 and 9, there is shown only the reservoir portion 3*b* of the brush. At that end, which in the figures it the lower end, it extends by a thinner, flexible, bell-like wall 45*b*, preferably in a bellows shape. The paste material is charged through the end 46*b* of this wall, and accordingly such an end is closed, squeezed and in case bent over and sealed, similarly as done for cream and tooth paste tubes. Therefore, it is preferably forced back into reservoir 3*b* (FIG. 9), so that the reservoir edge has always a neat and aesthetically pleasant appearance, and may be laid down on a plane. Preferably, but not necessarily, a cover 4*b* is provided for pressure insertion in the end of reservoir 3*b* by partially squeezing the bellows wall 45*b*, said cover 4*b* carrying hooking or suspending means 37*b*.

Of course, changes and modifications can be made to the above described assembly, without departing from the scope of the present invention.

What I claim is:

1. A brush assembly comprising:

a generally tubular dispenser container for paste material;

a substantially rigid bristle holder head member having a bristle arrangement on an outer face and having an internal cavity opening through an end thereof:

an elongated stem extending from one end of said container and having a hollow interior communicating with the interior of said container;

a dispensing opening in a side of said stem remote from said container, and a vent opening in said stem adjacent said container, the shape and size of said stem corresponding to the shape and size of said internal cavity;

a dispensing hole extending from said internal cavity to the outer suface of said bristle holder amid said bristles, said dispensing hole being so located that it can be brought into and out of register with said dispensing opening when said stem is nested in said internal cavity;

the other end of said container defining a charging opening; and a closure for said charging opening having holding means engaging one of the inner and outer surfaces of said container and a skirt spaced from said holding means and engaging the other of said surfaces, said vent opening serving to vent air from said container during charging.

2. An assembly according to claim 1, wherein said bristle holder head member is rotatable on said stem through at least a limited arc, and said bristle holder head member being rotatable from one position, where the dispensing hole is not in register with the dispensing opening, to a position where said dispensing hole is in register with said dispensing opening.

3. An assembly according to claim 1, wherein said bristle holder head member is mounted for longitudinal translation on the stem and wherein a spring means is provided between said bristle holder head member and stem, which bristle holder head member can be accordingly moved between a position, where the dispensing hole is not in register with the dispensing opening, and a position where said dispensing hole is in register with said dispensing opening.

4. An assembly according to claim 1, wherein said container and bristle holder head member carry reference means for indicating the mutual closing and/or opening position for paste material dispensing.

5. An assembly according to claim 1, wherein said closure is provided with a charging hole for the paste material of a diameter less than said opening, said hole being closed by a plug.

6. An assembly according to claim 5, wherein said charging hole threadedly receives said plug.

7. An assembly according to claim 6, wherein the size and thread of said hole in the cap are such that the outlet mouth of a tooth paste tube can be engaged thereby.

8. An assembly according to claim 5, wherein said closure has hooking mean for suspending the brush under rest or inoperative conditions.

* * * * *